US011123984B2

(12) United States Patent
Takeuchi

(10) Patent No.: US 11,123,984 B2
(45) Date of Patent: Sep. 21, 2021

(54) LIQUID EJECTING HEAD, METHOD FOR MANUFACTURING LIQUID EJECTING HEAD, AND LIQUID EJECTING SYSTEM

(71) Applicant: SEIKO EPSON CORPORATION, Tokyo (JP)

(72) Inventor: Masahiro Takeuchi, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/928,681

(22) Filed: Jul. 14, 2020

(65) Prior Publication Data

US 2021/0016567 A1 Jan. 21, 2021

(30) Foreign Application Priority Data

Jul. 17, 2019 (JP) ..... JP2019-131747

(51) Int. Cl.
*B41J 2/14* (2006.01)
*B41J 2/175* (2006.01)

(52) U.S. Cl.
CPC ..... *B41J 2/14* (2013.01); *B41J 2/175* (2013.01)

(58) Field of Classification Search
CPC ..... B41J 2/14; B41J 2/14233; B41J 2/175
USPC ..... 347/20, 40, 47, 54, 68
See application file for complete search history.

(56) References Cited

U.S. PATENT DOCUMENTS 10,471,715 B2 * 11/2019 Hayashi ..... B41J 2/04548
10,894,408 B2 * 1/2021 Takabe ..... B41J 2/14201
2009/0071937 A1 * 3/2009 Yamashita ..... B41J 2/14314 216/27
2019/0366714 A1 12/2019 Tsukahara et al.

FOREIGN PATENT DOCUMENTS

JP 2018-103602 A 7/2018

* cited by examiner

*Primary Examiner* — An H Do
(74) *Attorney, Agent, or Firm* — Workman Nydegger

(57) ABSTRACT

A liquid ejecting head with a supply port and an outlet port includes a pressurization chamber communicating with one of the suplly port and the outlet port, a first flow path communicating with the pressurization chamber and extending in a first axial direction, a second flow path communicating with the other of the supply port and the outlet port and extending in a second axial direction orthogonal to the first axial direction, and a nozzle that is provided to branch from the second flow path and that discharges the liquid along the first axial direction. When viewed in a third axial direction orthogonal to the first axial direction and the second axial direction, an inner wall at a location at which the second flow path and the first flow path intersect includes an inclined surface inclined with respect to the first axial direction and the second axial direction.

9 Claims, 11 Drawing Sheets

LIQUID EJECTING HEAD, METHOD FOR MANUFACTURING LIQUID EJECTING HEAD, AND LIQUID EJECTING SYSTEM

The present application is based on, and claims priority from JP Application Serial Number 2019-131747, filed Jul. 17, 2019, the disclosure of which is hereby incorporated by reference herein in its entirety.

BACKGROUND

1. Technical Field

The present disclosure relates to a liquid ejecting head, a method for manufacturing a liquid ejecting head, and a liquid ejecting system that eject liquid from a nozzle, and more particularly, to an ink jet recording head, a method for manufacturing a liquid ejecting head, and an ink jet recording system that eject ink as a liquid.

2. Related Art

There has been proposed a liquid ejecting system that circulates liquid inside a liquid ejecting head that ejects the liquid. The liquid ejecting system circulates the liquid to, for example, discharge bubbles contained in the liquid, suppress an increase in the viscosity of the liquid, and suppress settling of a component contained in the liquid in the liquid ejecting head (for example, refer to JP-A-2018-103602).

In the liquid ejecting head of JP-A-2018-103602, the liquid inside the liquid ejecting head is circulated through a branched flow path provided in the vicinity of the nozzles, thereby suppressing an increase in the viscosity caused by drying of the liquid not ejected from the nozzles.

However, there is a desire for a liquid ejecting head capable of more efficiently collecting the liquid in the vicinity of the nozzles.

This problem exists not only in an ink jet recording head but also similarly in a liquid ejecting head that ejects a liquid other than the ink.

SUMMARY

An advantage of some aspects of the present disclosure is to provide a liquid ejecting head, a method for manufacturing a liquid ejecting head, and a liquid ejecting system capable of more efficiently collecting liquid in the vicinity of a nozzles.

According to an aspect of the present disclosure, there is provided a liquid ejecting head having a supply port and a outlet port for a liquid, the liquid ejecting head including a pressurization chamber communicating with one of the supply port and the outlet port, a first flow path communicating with the pressurization chamber and extending in a first axial direction, a second flow path communicating with the other of the supply port and the outlet port, branching from the first flow path, and extending in a second axial direction orthogonal to the first axial direction, and a nozzle that is provided to branch from the second flow path and that discharges the liquid along the first axial direction, in which when viewed in a third axial direction orthogonal to the first axial direction and the second axial direction, an inner wall at a location at which the second flow path and the first flow path intersect includes an inclined surface inclined with respect to the first axial direction and the second axial direction.

According to another aspect of the present disclosure, there is provided a liquid ejecting system including the liquid ejecting head and a mechanism for supplying the liquid to the supply port, collecting the liquid from the outlet port, and circulating the liquid.

According to still another aspect of the present disclosure, there is provided a method for manufacturing a liquid ejecting head including a supply port and a outlet port for a liquid, a pressurization chamber communicating with one of the supply port and the outlet port, a first flow path communicating with the pressurization chamber and extending in a first axial direction, and a second flow path communicating with the other of the supply port and the outlet port, branching from the first flow path, and extending in a second axial direction orthogonal to the first axial direction, and a nozzle that is provided to branch from the second flow path and that discharges the liquid along the first axial direction, and when viewed in a third axial direction orthogonal to the first axial direction and the second axial direction, an inner wall at a location at which the second flow path and the first flow path intersect includes an inclined surface inclined with respect to the first axial direction and the second axial direction, the method including forming the inclined surface by isotropically etching a substrate, and forming at least part of the first flow path in the first axial direction by anisotropically etching portions other than the inclined surface of the substrate on which the inclined surface is formed.

DESCRIPTION OF EXEMPLARY EMBODIMENTS

Figure 1:
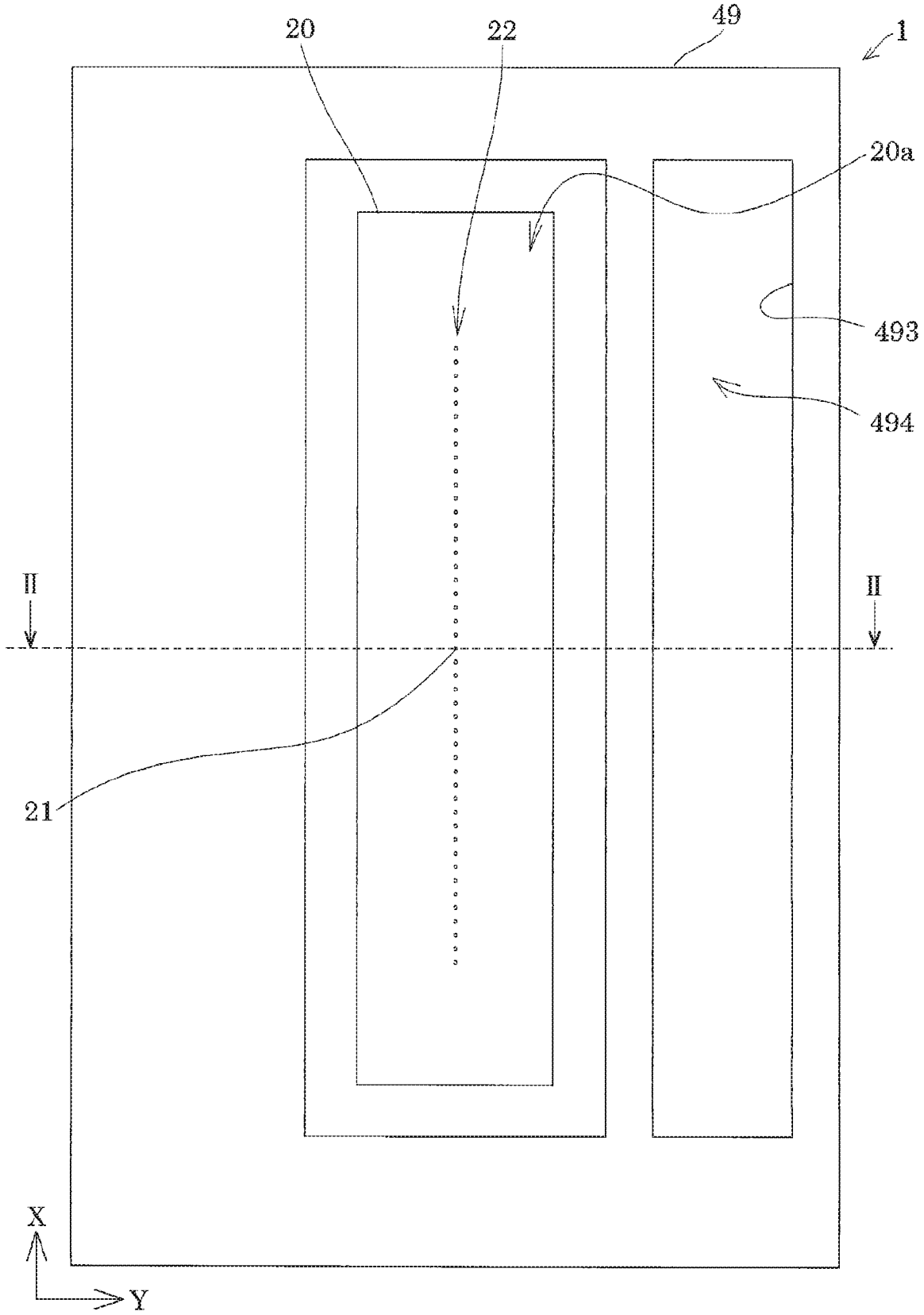
FIG. 1 is a plan view of a recording head according to Embodiment 1.

Hereinafter, the present disclosure will be described in detail based on the embodiments. However, the following description illustrates an embodiment of the present disclosure and may be optionally changed within the scope of the present disclosure. In the drawings, the same reference numerals denote the same members and the description thereof will be omitted as appropriate. In the drawings, X, Y, and Z represent three spatial axes orthogonal to each other. In the present specification, directions along these axes are defined as an X direction, a Y direction, and a Z direction. The directions of the arrows in the diagrams are illustrated as positive (+) directions and the directions opposite from the arrows are illustrated as negative (−) directions. The Z direction indicates a vertical direction, the +Z direction indicates vertically downward, and the −Z direction indicates vertically upward.

Embodiment 1

Figure 2:
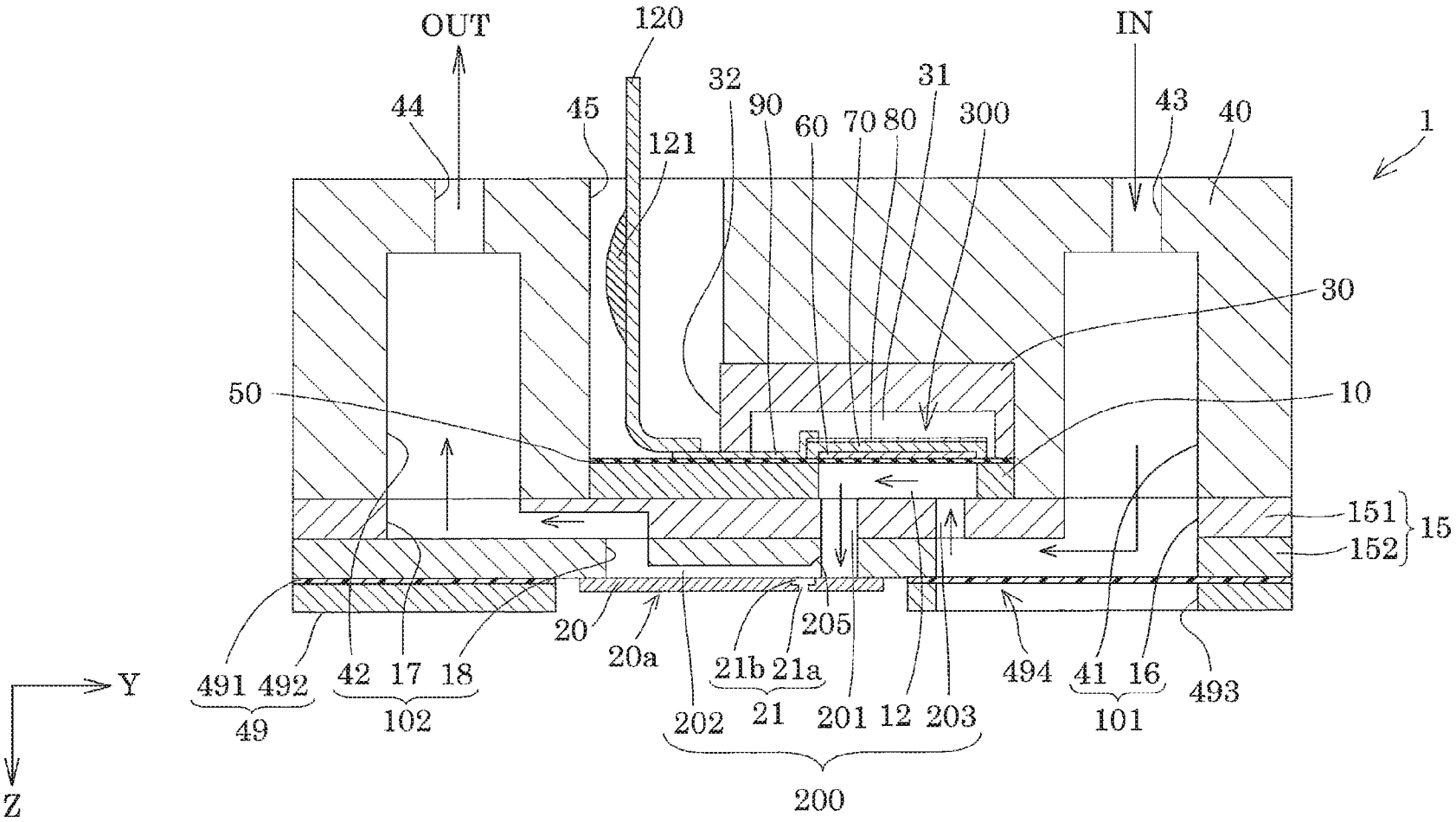
FIG. 2 is a sectional diagram of the recording head according to Embodiment 1.
Figure 3:
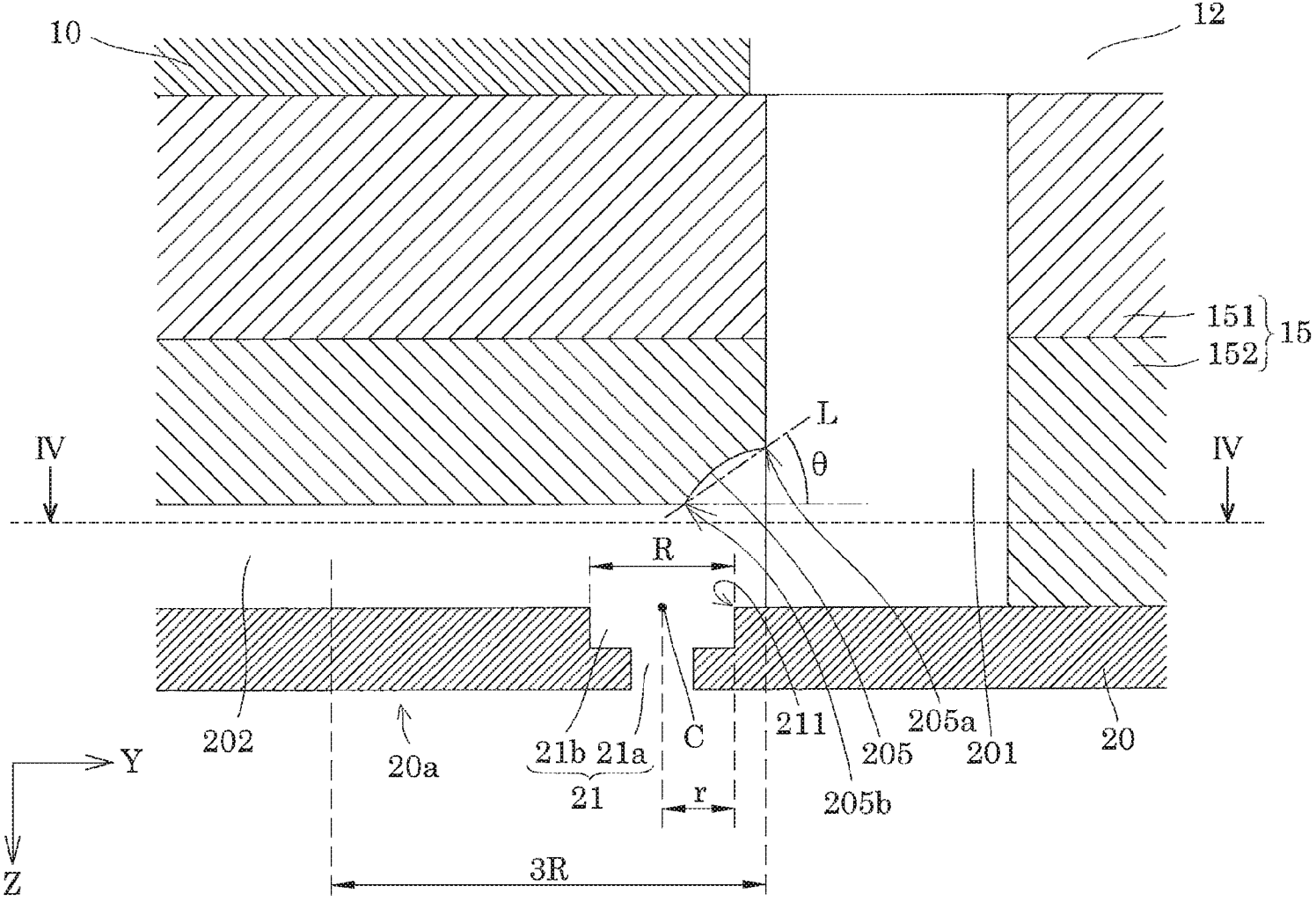
FIG. 3 is a sectional diagram of the recording head according to Embodiment 1.
Figure 4:
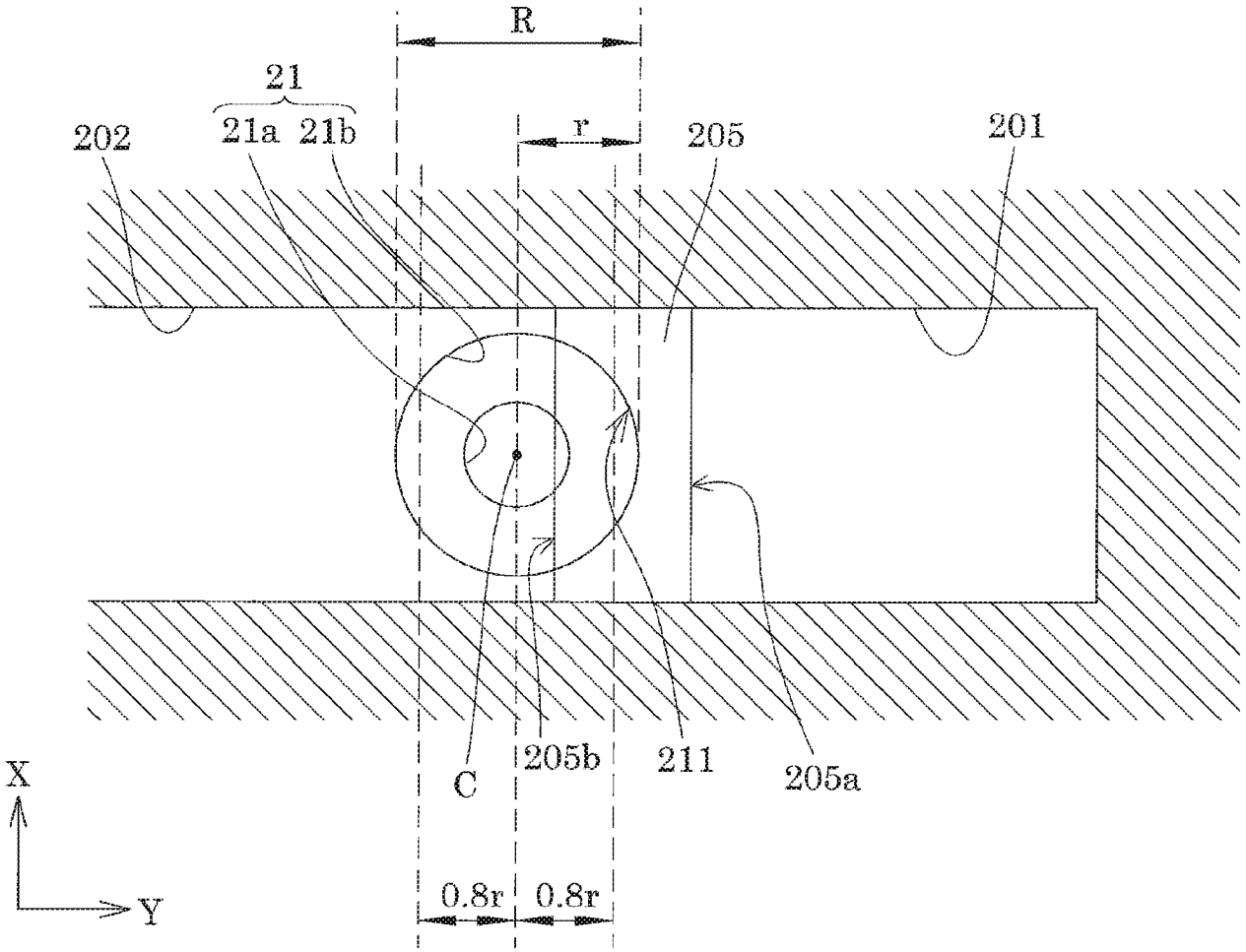
FIG. 4 is a sectional diagram of the recording head according to Embodiment 1.
Figure 5:
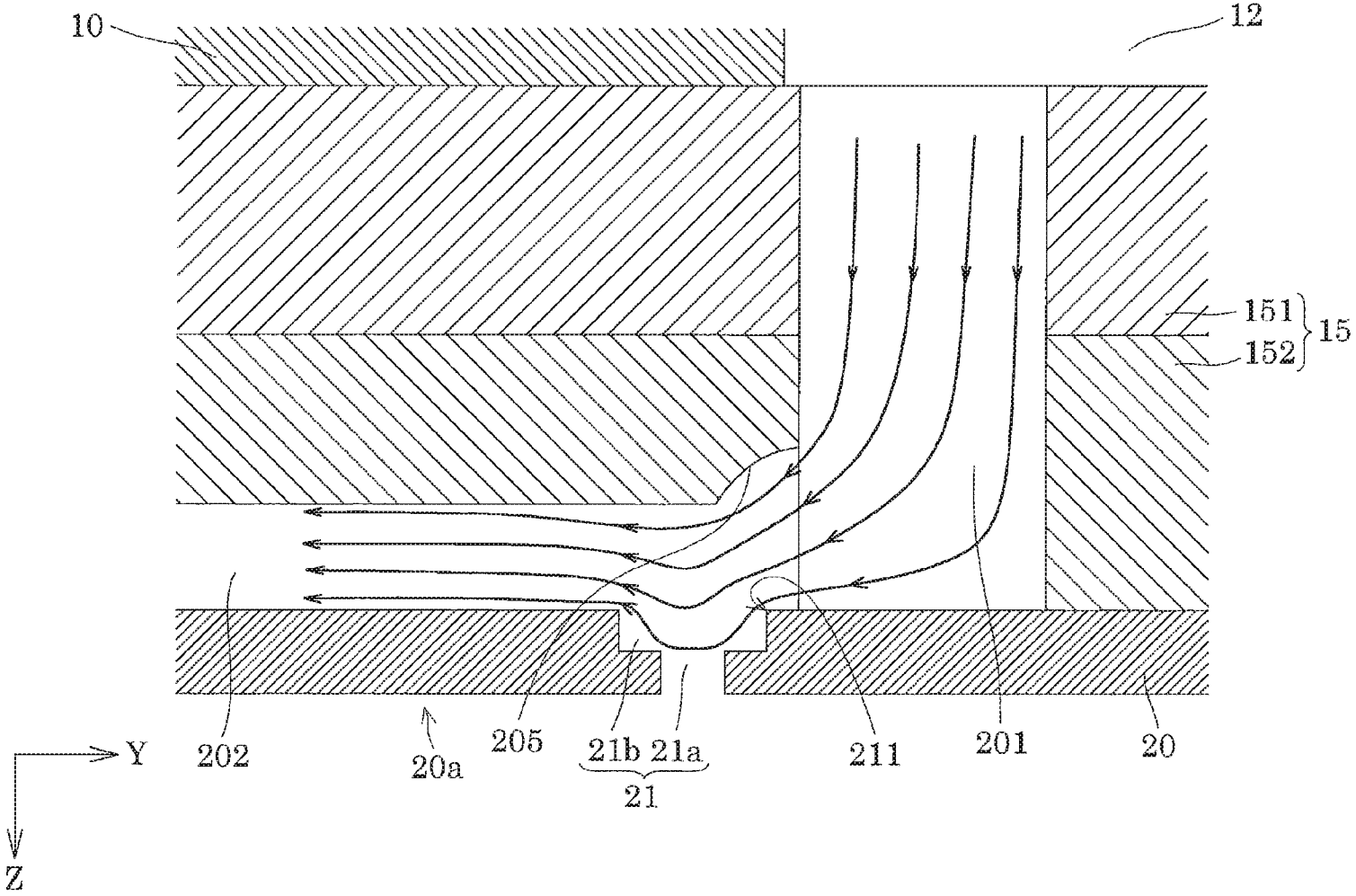
FIG. 5 is a sectional diagram illustrating streamlines of the recording head according to Embodiment 1.
Figure 6:
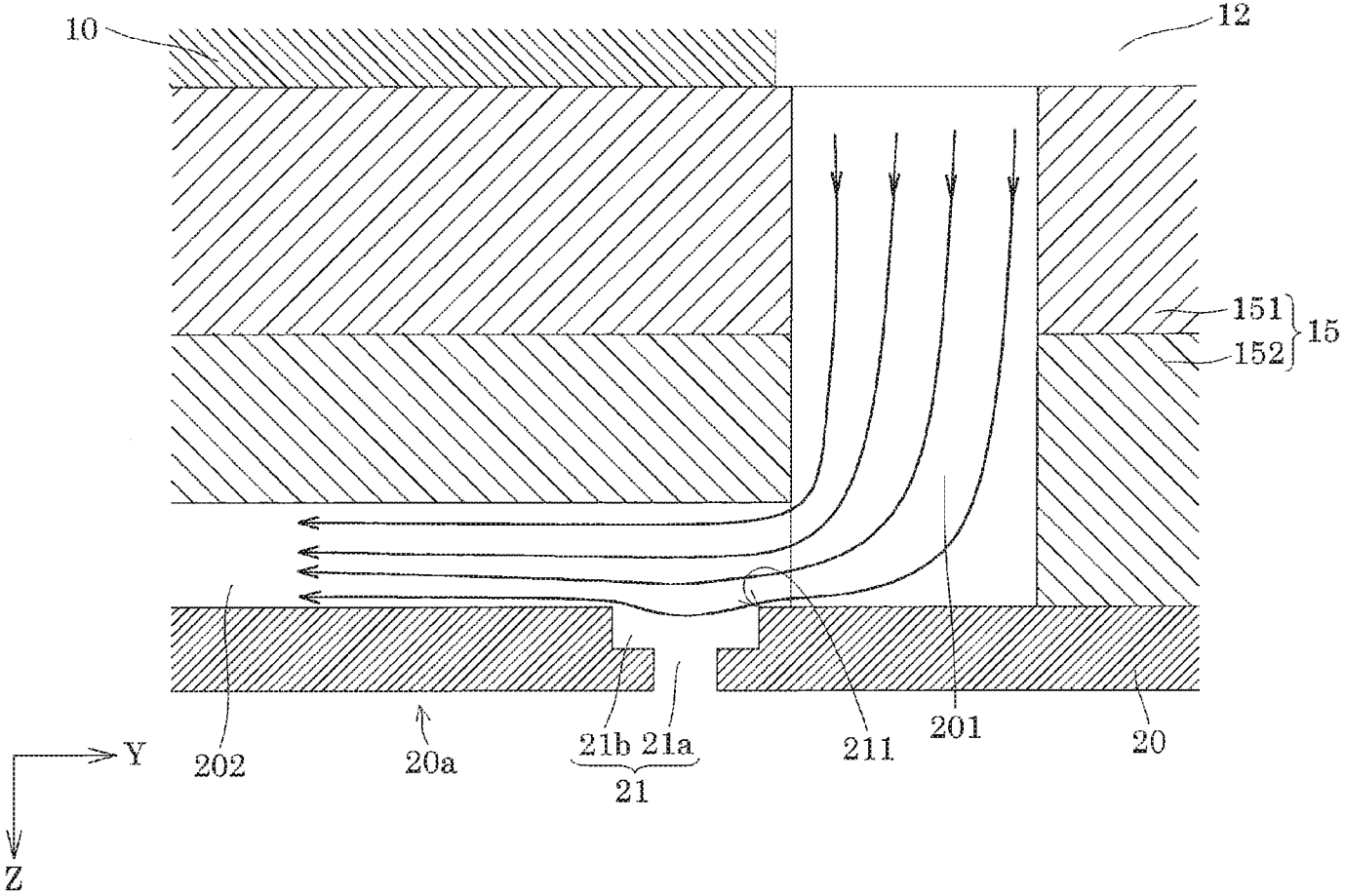
FIG. 6 is a sectional diagram illustrating streamlines of a comparative example of the recording head according to Embodiment 1.

An ink jet recording head, which is an example of the liquid ejecting head of the present embodiment, will be described with reference to FIGS. 1 to 6. FIG. 1 is a plan view of an ink jet recording head, which is an example of a liquid ejecting head according to Embodiment 1 of the present disclosure, as viewed from a nozzle surface side. FIG. 2 is a sectional diagram taken along line II-II of FIG. 1. FIG. 3 is an enlarged view of the main parts of FIG. 2. FIG. 4 is a sectional diagram taken along line IV-IV of FIG. 3. FIG. 5 is a diagram for explaining the streamlines inside the flow path of FIG. 3. FIG. 6 is a diagram illustrating the streamlines inside the flow path of a comparative example.

As illustrated in the drawings, an ink jet recording head 1 (hereinafter, also simply referred to as a recording head 1), which is an example of the liquid ejecting head of the present embodiment, is provided with members such as a flow path forming substrate 10 as flow path substrate, a communicating plate 15, a nozzle plate 20, a protection substrate 30, a case member 40, and a compliance substrate 49.

The flow path forming substrate 10 is formed of a silicon single crystal substrate and a diaphragm 50 is formed on one surface of the flow path forming substrate 10. The diaphragm 50 may be a single layer or a laminate selected from a silicon dioxide layer and a zirconium oxide layer.

The flow path forming substrate 10 is provided with pressure chambers 12 configuring individual flow paths 200, the pressure chambers 12 being partitioned by partition walls. The pressure chambers 12 are arranged at a predetermined pitch along the X direction in which nozzles 21 that discharge the ink are arranged. In the present embodiment, one row of the pressure chambers 12 is provided to be arranged in the X direction. The flow path forming substrate 10 is disposed such that the in-plane direction includes the X direction and the Y direction. In the present embodiment, the portions between the pressure chambers 12 arranged in the X direction of the flow path forming substrate 10 are referred to as partition walls. The partition walls are formed along the Y direction. In other words, the partition walls refer to portions overlapping the pressure chambers 12 in the Y direction of the flow path forming substrate 10.

Although the flow path forming substrate 10 is provided with only the pressure chambers 12 in the present embodiment, the flow path forming substrate 10 may be provided with a flow path resistance imparting portion having a narrower cross-sectional area crossing the flow paths than the pressure chambers 12 so as to impart the ink to be supplied to the pressure chambers 12 with a flow path resistance.

Piezoelectric actuators 300 are configured by forming the diaphragms 50 on one side of the flow path forming substrate 10 in the −Z direction and by laminating first electrodes 60, piezoelectric layers 70, and second electrodes 80 on the diaphragm 50 using film formation and lithography. In the present embodiment, the piezoelectric actuator 300 is an energy generating element that generates pressure changes in the ink inside the pressure chamber 12. Here, the piezoelectric actuator 300 is also referred to as a piezoelectric element and refers to a portion including the first electrode 60, the piezoelectric layer 70, and the second electrode 80. In general, one of the electrodes of the piezoelectric actuator 300 is used as a common electrode and the other electrode and the piezoelectric layer 70 are patterned for each pressure chamber 12. In the present embodiment, although the first electrode 60 is used as the common electrode of the piezoelectric actuator 300 and the second electrode 80 is used as the individual electrode of the piezoelectric actuator 300, there is no impediment to reversing this configuration in consideration of the drive circuit and wiring. In the example described above, although the diaphragm 50 and the first electrode 60 act as a diaphragm, the configuration is not limited thereto. For example, a configuration may be adopted in which the diaphragm 50 is not provided and only the first electrode 60 acts as a diaphragm. The piezoelectric actuator 300 itself may substantially serve as the diaphragm.

A respective lead electrode 90 is coupled to the second electrode 80 of each of the piezoelectric actuators 300 and a voltage is selectively applied to each of the piezoelectric actuators 300 via the lead electrodes 90.

The protection substrate 30 is joined to the −Z direction surface of the flow path forming substrate 10.

A piezoelectric actuator holding portion 31 having enough space to not hinder the motion of the piezoelectric actuator 300 is provided in a region of the protection substrate 30 facing the piezoelectric actuator 300. The piezoelectric actuator holding portion 31 only needs to have enough space to not hinder the motion of the piezoelectric actuator 300 and the space may be sealed or not sealed. The piezoelectric actuator holding portion 31 is formed to have a size that integrally covers the row of the piezoelectric actuators 300 arranged in the X direction. Naturally, the piezoelectric actuator holding portion 31 is not particularly limited to this configuration, and may individually cover the piezoelectric actuators 300, and may cover each group configured of two or more piezoelectric actuators 300 arranged in the X direction.

For the protection substrate 30, it is preferable to use a material having substantially the same coefficient of thermal expansion as the flow path forming substrate 10, for example, glass, ceramic material, or the like. In the present embodiment, a silicon single crystal substrate of the same material as the material of the flow path forming substrate 10 is used to form the protection substrate 30.

The protection substrate 30 is provided with a through-hole 32 extending through the protection substrate 30 in the Z direction. The vicinity of the end portion of the lead electrode 90 extending from each of the piezoelectric actuators 300 is provided to extend so as to be exposed inside the through-hole 32 and is electrically coupled to a flexible cable 120 inside the through-hole 32. The flexible cable 120 is a flexible wiring substrate, and in the present embodiment, a drive circuit 121 which is a semiconductor element is mounted to the flexible cable 120. The lead electrode 90 and the drive circuit 121 may be electrically coupled to each other without being coupled via the flexible cable 120. A flow path may be provided in the protection substrate 30.

The case member 40 that partitions a supply flow path communicating with the pressure chambers 12 and that partitions the protection substrate 30 is fixed onto the protection substrate 30. The case member 40 is joined to a surface of the protection substrate 30 on the opposite side from the flow path forming substrate 10 and is also joined to the communicating plate 15 (described later).

The case member 40 is provided with a first liquid chamber portion 41 that forms part of a first common liquid chamber 101 and a second liquid chamber portion 42 that forms part of a second common liquid chamber 102. The first liquid chamber portion 41 and the second liquid chamber portion 42 are provided in the Y direction on both sides of one row of the pressure chambers 12.

Each of the first liquid chamber portion 41 and the second liquid chamber portion 42 has a concave shape opened on the −Z side surface of the case member 40 and is provided continuously to extend over the pressure chambers 12 arranged in the X direction.

The case member 40 is provided with a supply port 43 that communicates with the first liquid chamber portion 41 to supply the ink to the first liquid chamber portion 41 and a outlet port 44 that communicates with the second liquid chamber portion 42 and discharges the ink from the second liquid chamber portion 42.

Furthermore, the case member 40 is further provided with a coupling port 45 which communicates with the through-hole 32 of the protection substrate 30 and through which the flexible cable 120 is inserted.

On the other hand, the communicating plate 15, the nozzle plate 20, and the compliance substrate 49 are provided on the +Z side of the flow path forming substrate 10 which is the opposite side from the protection substrate 30.

The nozzles 21 that eject the ink in the +Z direction are formed in the nozzle plate 20. In other words, the nozzle plate 20 of the present embodiment corresponds to a nozzle substrate. In the present embodiment, as illustrated in FIG. 1, the nozzles 21 are disposed in a straight line along the X direction, thereby forming one nozzle row 22. The nozzle 21 is formed in a member different from a member, which is the communicating plate 15 in the present embodiment, provided with a first flow path 201, and is formed in the nozzle plate 20.

Each nozzle 21 includes a first nozzle 21*a* and a second nozzle 21*b* having different inner diameters disposed next to each other in the Z direction which is the plate thickness direction of the nozzle plate 20. The first nozzle 21*a* has a smaller inner diameter than the second nozzle 21*b*. The first nozzle 21*a* is disposed outside, that is, on the +Z side of the nozzle plate 20 and ink is ejected to the outside as an ink droplet from the first nozzle 21*a* in the +Z direction. That is, ink droplets are discharged from the nozzle 21 of the present embodiment in the +Z direction, which is the first direction.

The second nozzle 21*b* is disposed on the −Z side of the nozzle plate 20 and communicates with a +Z side end portion of the first flow path 201 extending in the +Z direction which is described later in detail.

It is possible to improve the flow speed of the ink by providing the nozzle 21 with the first nozzle 21*a* having a relatively small inner diameter and it is thus possible to improve the flight speed of the ink droplet ejected from the nozzle 21. By providing the nozzle 21 with the second nozzle 21*b* having a relatively large inner diameter, when so-called circulation is performed in which the ink inside the individual flow path 200 is caused to flow from the first common liquid chamber 101 toward the second common liquid chamber 102 (described in detail later), it is possible to reduce the portion of the nozzle 21 that is not influenced by the circulation flow inside the nozzle 21. In other words, it is possible to generate an ink flow inside the second nozzle 21*b* during the circulation and it is possible to increase the velocity gradient of the ink inside the nozzle 21 to replace the ink inside the nozzle 21 with new ink supplied from upstream. However, when the inner diameter of the second nozzle 21*b* is excessively large as compared with the inner diameter of the first nozzle 21*a*, the ratio of the inertance between the second nozzle 21*b* and the first nozzle 21*a* increases, and the position of the meniscus of the ink inside the nozzle 21 is not stable when the ink droplets are continuously discharged. In other words, when the ratio of the inertance between the second nozzle 21*b* and the first nozzle 21*a* increases, the meniscus of the ink moves into the second nozzle 21*b* instead of being retained inside the first nozzle 21*a* and it is no longer possible to continue the stable discharging of the ink droplets.

When the inner diameter of the second nozzle 21*b* is excessively small, the ink flow inside the second nozzle 21*b* during the circulation is less likely to occur. When the inner diameter of the second nozzle 21*b* is excessively small, the flow path resistance from the pressure chamber 12 to the nozzle 21 increases and the pressure loss increases, and the weight of the ink droplet discharged from the nozzle 21 therefore decreases. As a result, the piezoelectric actuator 300 is to be driven at a higher drive voltage and the discharging efficiency is reduced. Accordingly, the sizes of the first nozzle 21*a* and the second nozzle 21*b* are determined, as appropriate, in consideration of the ink replacement performance during circulation, the discharging stability, the discharging efficiency, the flight speed of the ink droplet, and the like.

The first nozzle 21*a* and the second nozzle 21*b* are provided so that the opening shapes thereof are substantially the same over the Z direction. Accordingly, a level difference is formed between the first nozzle 21*a* and the second nozzle 21*b*. Naturally, the shapes of the first nozzle 21*a* and the second nozzle 21*b* are not limited thereto, and for example, the inner surface of the second nozzle 21*b* may be an inclined surface inclined with respect to the Z direction. In other words, the inner diameter of the second nozzle 21*b* may be provided so as to gradually decrease toward the first nozzle 21*a*. Accordingly, for example, a level difference may not be formed between the first nozzle 21*a* and the second nozzle 21*b* and a continuous inner surface may be formed. In this manner, when the inner surfaces of the first nozzle 21*a* and the second nozzle 21*b* are continuous, the first nozzle 21*a* refers to a portion in which the opening shape is substantially the same over the Z direction.

The shape of the nozzle 21 when viewed in plan view in the Z direction is not particularly limited, and may be a circle, an ellipse, a rectangle, a polygon, a bulbous shape, or the like.

It is possible to form the nozzle plate 20 by using, for example, a metal such as stainless steel (SUS), an organic material such as a polyimide resin, or a flat plate material such as silicon. The plate thickness of the nozzle plate 20 is preferably 60 μm to 100 μm. By using the nozzle plate 20 having such a plate thickness, it is possible to improve the handleability of the nozzle plate 20 and to improve the ease of assembly of the recording head 1. Although it is possible to reduce the size of a portion of the nozzle 21 that is not influenced by the circulation flow inside the nozzle 21 during the circulation of the ink by reducing the length of the nozzle 21 in the Z direction, it is necessary to reduce the thickness of the nozzle plate 20 in the Z direction in order to reduce the length of the nozzle 21 in the Z direction. When the thickness of the nozzle plate 20 is reduced in this manner, there is an increase in the likelihood of the rigidity of the nozzle plate 20 being reduced and the deformation of the nozzle plate 20 causing variation in the discharging direction of the ink droplets, and an increase in the likelihood of a reduction in the handleability of the nozzle plate 20 causing a reduction in the ease of assembly to occur. In other words, by using the nozzle plate 20 having a certain degree of thickness as described above, it is possible to suppress a reduction in the rigidity of the nozzle plate 20 and it is possible to suppress the occurrence of variation in the discharging direction caused by the deformation of the nozzle plate 20 and a reduction in the ease of assembly caused by a reduction in the handleability.

The communicating plate 15 includes a first communicating plate 151 and a second communicating plate 152 in the present embodiment. The first communicating plate 151 and the second communicating plate 152 are laminated in the Z direction such that the first communicating plate 151 is on the −Z side and the second communicating plate 152 is on the +Z side.

The first communicating plate 151 and the second communicating plate 152 which form the communicating plate 15 may be made of a metal such as stainless steel, glass, a ceramic material, or the like. It is preferable that the communicating plate 15 be formed by using a material having substantially the same thermal expansion coefficient as that of the flow path forming substrate 10. In the present embodiment, the communicating plate 15 is formed by using a silicon single crystal substrate of the same material as the material of the flow path forming substrate 10.

The communicating plate 15 is provided with a first communicating portion 16 which communicates with the first liquid chamber portion 41 of the case member 40 to form part of the first common liquid chamber 101, and a second communicating portion 17 and a third communicating portion 18 which communicate with the second liquid chamber portion 42 of the case member 40 to form part of the second common liquid chamber 102. As will be described in detail later, the communicating plate 15 is provided with a flow path that communicates the first common liquid chamber 101 and the pressure chamber 12 with each other, a flow path that communicates the pressure chamber 12 and the nozzle 21 with each other, and a flow path that communicates the nozzle 21 with the second common liquid chamber 102 with each other. The flow paths provided in the communicating plate 15 form part of the individual flow path 200.

The first communicating portion 16 is provided at a position overlapping the first liquid chamber portion 41 of the case member 40 in the Z direction and is provided to extend through the communicating plate 15 in the Z direction to be opened in both the +Z side surface and the −Z side surface of the communicating plate 15. The first communicating portion 16 forms a first common liquid chamber 101 by communicating with the first liquid chamber portion 41 on the −Z side. In other words, the first common liquid chamber 101 is formed by the first liquid chamber portion 41 of the case member 40 and the first communicating portion 16 of the communicating plate 15. The first communicating portion 16 extends in the −Y direction to a position overlapping the pressure chamber 12 in the Z direction on the +Z side. The first common liquid chamber 101 may be formed by the first liquid chamber portion 41 of the case member 40 without providing the first communicating portion 16 in the communicating plate 15.

The second communicating portion 17 is provided at a position overlapping the second liquid chamber portion 42 of the case member 40 in the Z direction and is provided to be open on the −Z side surface of the first communicating plate 151. The second communicating portion 17 is provided to widen toward the nozzle 21 in the +Y direction on the +Z side.

The third communicating portion 18 is provided to extend through the second communicating plate 152 in the Z direction such that one end of the third communicating portion 18 communicates with a portion of the second communicating portion 17 that is widened in the +Y direction. The opening on the +Z side of the third communicating portion 18 is covered by the nozzle plate 20. In other words, by providing the second communicating portion 17 on the first communicating plate 151, only the opening on the +Z side of the third communicating portion 18 may be covered by the nozzle plate 20, and thus, it is possible to provide the nozzle plate 20 in a relatively small area and it is possible to reduce the cost.

The second common liquid chamber 102 is formed by the second communicating portion 17 and the third communicating portion 18 provided in the communicating plate 15 and the second liquid chamber portion 42 provided in the case member 40. The second common liquid chamber 102 may be formed by the second liquid chamber portion 42 of the case member 40 without providing the second communicating portion 17 and the third communicating portion 18 in the communicating plate 15.

The compliance substrate 49 including a compliance portion 494 is provided on a surface of the communicating plate 15 on the +Z side surface in which the first communicating portion 16 is opened. The compliance substrate 49 seals the opening of the first common liquid chamber 101 on a nozzle surface 20*a* side.

In the present embodiment, the compliance substrate 49 includes a sealing film 491 formed of a thin flexible film and a fixed substrate 492 formed of a hard material such as a metal. Since the region of the fixed substrate 492 facing the first common liquid chamber 101 is an opening portion 493 completely removed in the thickness direction, part of the wall surface of the first common liquid chamber 101 is the compliance portion 494 which is a flexible portion sealed only by the flexible sealing film 491. By providing the compliance portion 494 on part of the wall surface of the first common liquid chamber 101 in this manner, it is possible to absorb the pressure fluctuation of the ink inside the first common liquid chamber 101 by the compliance portion 494 being deformed.

The flow path forming substrate 10, the communicating plate 15, the nozzle plate 20, the compliance substrate 49, and the like which form the flow path substrate are provided with the individual flow paths 200 which communicate with the first common liquid chamber 101 and the second common liquid chamber 102 and through which the ink in the first common liquid chamber 101 flows to the second common liquid chamber 102. Here, each of the individual flow paths 200 of the present embodiment is provided for corresponding one of the nozzles 21 in communication with the first common liquid chamber 101 and the second common liquid chamber 102, and includes the nozzle 21. The individual flow paths 200 are arranged along the X direction, which is the direction in which the nozzles 21 are arranged. Two of the individual flow paths 200 adjacent in the X direction, which is the direction in which the nozzles 21 are arranged, are provided to communicate with the first common liquid chamber 101 and the second common liquid chamber 102, respectively. In other words, the individual flow paths 200 provided for the nozzles 21 are provided in communication only with the first common liquid chamber 101 and the second common liquid chamber 102, respectively, and the individual flow paths 200 do not communicate with each other except by the first common liquid chamber 101 and the second common liquid chamber 102. In other words, in the present embodiment, a flow path provided with one nozzle 21 and one pressure chamber 12 is referred to as the individual flow path 200, and each of the individual flow paths 200 is provided to communicate with the other individual flow paths 200 only by the first common liquid chamber 101 and the second common liquid chamber 102.

As illustrated in FIGS. 2 and 3, the individual flow path 200 includes the nozzle 21, the pressure chamber 12, the first flow path 201, a second flow path 202, and a supply path 203.

The pressure chamber 12 is provided between the recessed portion provided in the flow path forming substrate 10 and the communicating plate 15 as described above and extends in the Y direction. In other words, the pressure chamber 12 is provided such that the supply path 203 is coupled to one end portion of the pressure chamber 12 in the Y direction, the second flow path 202 is coupled to the other end portion in the Y direction, and the ink flows inside the pressure chamber 12 in the Y direction. In other words, the direction in which the pressure chamber 12 extends refers to the direction in which the ink flows inside the pressure chamber 12.

In the present embodiment, only the pressure chamber 12 is formed in the flow path forming substrate 10. However, the configuration is not limited thereto, and the upstream end portion of the pressure chamber 12, that is, the end portion in the +Y direction may be provided with the flow path resistance imparting portion having the cross-sectional area narrower than that of the pressure chamber 12 to impart flow path resistance.

The supply path 203 couples the pressure chamber 12 to the first common liquid chamber 101 to each other and is provided to extend through the first communicating plate 151 in the Z direction. The supply path 203 communicates with the first common liquid chamber 101 at the end portion on the +Z side and communicates with the pressure chamber 12 at the end portion on the −Z side. In other words, the supply path 203 extends in the Z direction. Here, the direction in which the supply path 203 extends refers to the direction in which the ink flows inside the supply path 203.

The first flow path 201 is provided to extend between the pressure chamber 12 and the second flow path 202 in the Z direction, which is the first axial direction. The direction in which the first flow path 201 extends refers to the direction in which the ink flows inside the first flow path 201. In other words, the first axial direction in which the first flow path 201 extends is the Z direction in the present embodiment. In the present embodiment, the first flow path 201 is provided to extend through the communicating plate 15 in the Z direction, communicates with the pressure chamber 12 at an end portion in the −Z direction, and communicates with the second flow path 202 at an end portion in the +Z direction. The expression that the direction in which the first flow path 201 extends is the Z direction includes that the direction in which the first flow path 201 extends includes a vector, which is a component of the Z direction. That is, the first flow path 201 may be provided to be inclined with respect to the Z direction as long as the first flow path 201 does not extend in the X direction or the Y direction containing no component in the Z direction at all.

The first flow path 201 refers to a portion formed in the communicating plate 15. In other words, the first flow path 201 extends from the bottom surface of the pressure chamber 12 in the +Z direction to the portion covered by the nozzle plate 20.

The flow path-crossing cross-sectional shape of the first flow path 201, that is, the cross-sectional shape in the plane direction including the X direction and the Y direction is rectangular. The flow path-crossing cross-sectional shape of the first flow path 201 is not particularly limited, and may be a circle, an ellipse, a trapezoid, a polygon, or the like.

The first flow path 201 of the present embodiment is formed such that the opening shape is the same over the Z direction. That is, the cross-sectional shape and the cross-sectional area of the first flow path 201 in the plane direction including the X direction and the Y direction are the same over the Z direction. Naturally, the first flow path 201 may be formed such that the opening shape is a different shape along the Z direction.

The second flow path 202 is provided to extend in the −Y direction between the supply port 43 and the outlet port 44. The direction in which the second flow path 202 extends is the direction in which the ink inside the second flow path 202 flows. In other words, the second axial direction in which the second flow path 202 extends is the Y direction in the present embodiment. The +Y direction end portion of the second flow path 202 communicates with the first flow path 201 and the −Y direction end portion of the second flow path 202 communicates with the third communicating portion 18 of the second common liquid chamber 102.

The second flow path 202 of the present embodiment is provided between the second communicating plate 152 and the nozzle plate 20. Specifically, the second flow path 202 is formed by providing a recessed portion in the second communicating plate 152 and covering the opening of the recessed portion with the nozzle plate 20. The second flow path 202 is not particularly limited to this configuration and a recessed portion may be provided in the nozzle plate 20 and the recessed portion of the nozzle plate 20 may be covered with the second communicating plate 152, or alternatively, a recessed portion may be provided in both the second communicating plate 152 and the nozzle plate 20.

The flow path-crossing cross-sectional shape of the second flow path 202, that is, the cross-sectional shape in the plane direction including the X direction and the Z direction is rectangular. The flow path-crossing cross-sectional shape of the second flow path 202 is not particularly limited, and may be a trapezoid, a semicircle, a semi-ellipse, or the like.

In the present embodiment, the second flow path 202 is provided such that a cross-sectional area crossing the ink flowing through the flow path, that is, a cross-sectional area in the plane direction including the X direction and the Z direction has the same area over the Y direction. The second flow path 202 may be provided such that the flow path-crossing cross-sectional area has a different area over the Y direction. The difference in the area crossing the second flow path 202 includes a case in which the height in the Z direction is different, a case in which the width in the X direction is different, and a case in which both are different.

In other words, the second flow path 202 of the present embodiment refers to a portion that does not overlap the first flow path 201 when viewed in plan view in the Z direction.

The nozzle 21 is disposed at a position communicating with the middle of the second flow path 202. In other words, the nozzle 21 is provided to branch in the +Z direction from the second flow path 202 extending in the −Y direction. Accordingly, ink droplets are ejected from the nozzle 21 in the +Z direction. In other words, the nozzle 21 is provided to extend through the nozzle plate 20 in the Z direction such that the end portion of the nozzle 21 in the −Z direction communicates with the middle of the second flow path 202 and the end portion of the nozzle 21 in the +Z direction opens to the nozzle surface 20*a* of the nozzle plate 20. Therefore, the first axial direction in which the nozzle 21 ejects ink droplets is the Z direction.

Here, the nozzle 21 being provided to branch from the second flow path 202 means the nozzle 21 communicating with the middle of the second flow path 202. The nozzle 21 communicating with the middle of the second flow path 202 means that at least part of the nozzle 21 is disposed at a position overlapping the second flow path 202 when viewed in plan view in the Z direction. When the nozzle 21 is disposed at a position overlapping only the first flow path 201 when viewed in plan view in the Z direction, the nozzle 21 is not considered to be communicating with the middle of the second flow path 202. In other words, as described above, the second flow path 202 of the present embodiment is a portion that does not overlap the first flow path 201 when viewed in plan view in the Z direction.

It is preferable that the cross-sectional area crossing the ink flowing through the second flow path 202 with which the nozzle 21 communicates be smaller than the cross-sectional area crossing the ink flowing through the first flow path 201. The cross-sectional area crossing the first flow path 201 referred to here is the area of a cross-section in the plane direction including the X direction and the Y direction. The cross-sectional area crossing the second flow path 202 is the area of a cross-section in the plane direction including the Y direction and the Z direction. In this manner, by making the cross-sectional area of the second flow path 202 relatively small, it is possible to dispose the individual flow paths 200 densely in the X direction to densely dispose the nozzles 21 in the X direction, and it is possible to suppress an increase in the size of the recording head 1 in the X direction. By making the cross-sectional area of the first flow path 201 relatively large, it is possible to suppress a decrease in the flow path resistance from the pressure chamber 12 to the nozzle 21 to suppress reductions in the discharging properties of the ink droplets, in particular, in the weight of the ink droplets to be discharged. In particular, by widening the first flow path 201 in the Y direction to increase the cross-sectional area of the first flow path 201, it is possible to reduce the flow path resistance in the first flow path 201 and it is possible to dispose the individual flow paths 200 at a high density. In the present embodiment, the first flow path 201 and the second flow path 202 are provided with the same width in the X direction, and the width of the first flow path 201 in the Y direction is larger than the height of the second flow path 202 in the Z direction, and thus, the cross-sectional area of the second flow path 202 is rendered smaller than the cross-sectional area of the first flow path 201. Accordingly, it is possible to increase the cross-sectional area of the first flow path 201 and to dispose the first flow paths 201 and the second flow paths 202 at a high density in the X direction.

When viewed in the X direction, which is the third axial direction, an inclined surface 205 inclined with respect to the Z direction and the Y direction is provided on the inner walls of the location where the first flow path 201 and the second flow path 202 intersect. Here, the inner walls on which the inclined surface 205 is provided refers to the inside at the location at which the first flow path 201 and the second flow path 202 intersect, that is, the inner walls in the −Z direction and the −Y direction, as viewed in the X direction. In other words, a starting end 205*a* of the inclined surface 205 is the wall surface on the −Y side of the first flow path 201 and a terminating end 205*b* of the inclined surface 205 is the wall surface on the −Z side of the second flow path 202.

It is sufficient for the inclined surface 205 to be only inclined with respect to the Z direction and the Y direction. Here, the inclined surface 205 refers to the inclined surface 205 being provided such that the height of the second flow path 202 in the −Z direction gradually increases in the +Y direction. In other words, when viewed in plan view in the X direction, the inclined surface 205 refers to a surface formed by a line L connecting the starting end 205*a* of the inclined surface 205 on the first flow path 201 side and the terminating end 205*b* of the inclined surface 205 on the second flow path 202 side, where the line L is inclined in both the Z direction and the Y direction.

The inclined surface 205 may be a planar surface, may be a concave surface that is concave toward the outside of the flow path, that is, in a vector direction including the −Z direction and the −Y direction, and may be a convex surface that protrudes in a mountain shape toward the inside of the flow path, that is, in a vector direction including the +Z direction and the +Y direction. The inclined surface 205 of the present embodiment is formed as a concave surface that is concave toward the outside of the flow path.

The individual flow path 200 includes the supply path 203, the pressure chamber 12, the first flow path 201, and the second flow path 202 in order from upstream communicating with the first common liquid chamber 101 to downstream communicating with the second common liquid chamber 102. In the individual flow path 200, so-called circulation is performed in which the ink flows from the first common liquid chamber 101, through the individual flow path 200, to the second common liquid chamber 102. A pressure change is generated in the ink inside the pressure chamber 12 by driving the piezoelectric actuator 300 and the ink droplet is discharged from the nozzle 21 to the outside by increasing the pressure of the ink inside the nozzle 21. When the ink flows from the first common liquid chamber 101 to the second common liquid chamber 102 through the individual flow path 200, the piezoelectric actuator 300 may be driven, or the piezoelectric actuator 300 may be driven when the ink does not flow from the first common liquid chamber 101 to the second common liquid chamber 102 through the individual flow path 200. The flow of the ink from the second common liquid chamber 102 to the first common liquid chamber 101 may be temporarily generated by a pressure change caused by the driving of the piezoelectric actuator 300.

In the present embodiment, as illustrated in FIG. 5, by providing the inclined surface 205 inclined with respect to the Z direction and the Y direction on the inner walls at a location at which the first flow path 201 and the second flow path 202 intersect, when the ink flowing through the first flow path 201 in the +Z direction flows through the second flow path 202 in the −Y direction, it is possible to cause the ink to flow in the vector direction including the +Z direction and the −Y direction along the surface of the inclined surface 205, that is, toward the nozzle 21. By providing the inclined surface 205, it is possible to increase the flow speed of the ink flowing directly above the nozzle 21 along the inclined surface 205, that is, on the −Z side. In this manner, it is possible to cause the ink flowing from the first flow path 201 to the second flow path 202 to enter the nozzle 21, particularly, to enter the second nozzle 21*b* and to generate a flow of the ink inside the nozzle 21. By generating an ink flow inside the nozzle 21, it is possible to increase the velocity gradient of the ink inside the nozzle 21 to replace the ink inside the nozzle 21 with new ink supplied from upstream. Therefore, the ink inside the nozzle 21 does not easily increase in viscosity due to drying, and even if the ink inside the nozzle 21 increases in viscosity, since the ink flows downstream through the first flow path 201, it is possible to suppress the occurrence of variation in the discharging direction of the ink droplets caused by the increased-viscosity ink remaining inside the nozzle 21, and to suppress the displacement of the landing position of the ink droplets on the ejection target medium.

On the other hand, as illustrated in FIG. 6, for example, if the inclined surface 205 is not provided at the coupled portion between the first flow path 201 and the second flow path 202, the flow speed of the ink at the coupled portion between the first flow path 201 and the second flow path 202 does not become faster, the ink does not easily enter the nozzle 21, and the ink is retained in the nozzle 21. When the ink is retained inside the nozzle 21 in this manner, the retained ink easily increases in viscosity due to drying. Therefore, the discharging direction of the ink droplet discharged from the nozzle 21 is varied due to the increased-viscosity ink and the landing position of the discharged ink droplet on the ejection target medium is easily displaced.

As illustrated in FIG. 4, when viewed in the Z direction, the terminating end 205*b* of the inclined surface 205 on the side facing the second flow path 202 preferably overlaps an opening 211 of the nozzle 21 on the second flow path 202 side. In other words, it is preferable that the terminating end 205*b* of the inclined surface 205 be provided at a position mutually facing the opening 211 of the nozzle 21 in the Z direction.

In this manner, when viewed in the Z direction, by disposing the terminating end 205*b* of the inclined surface 205 at a position overlapping the opening 211 of the nozzle 21, it is possible to facilitate the ink flowing along the surface of the inclined surface 205 entering the nozzle 21. In other words, when the nozzle 21 is positioned further in the −Y direction than the terminating end 205*b* of the inclined surface 205, the ink flowing along the surface of the inclined surface 205 does not easily flow toward the nozzle 21 and the ink does not easily enter the nozzle 21. When the nozzle 21 is positioned further in the +Y direction than the terminating end 205*b* of the inclined surface 205, the nozzle 21 is not easily influenced by the flow of the ink by the inclined surface 205 and the ink does not easily enter the nozzle 21.

As illustrated in FIG. 4, when r is the radius of the opening 211 on the second flow path 202 side of the nozzle 21, and when viewed in the Z direction, the terminating end 205*b* of the inclined surface 205 is preferably disposed within a distance range of less than or equal to 0.8 times r from the center C of the opening 211. In other words, the terminating end 205*b* of the inclined surface 205 is preferably disposed within a distance range of 0.8 r from the center C of the opening 211 in the +Y direction and within a range of a distance of 0.8 r in the −Y direction. Here, the radius r of the opening 211 in the Y direction refers to half the width dimension R of the widest portion of the opening 211 in the Y direction, that is, R/2 when the opening shape of the opening 211 is a shape other than a circle, for example, an ellipse, an oval, a rectangle, a polygon, a bulbous shape, or the like. When the opening 211 has a shape other than a circle, for example, an ellipse, an oval, a rectangle, a polygon, a bulbous shape, or the like, the center C of the opening 211 is the area center of gravity.

As described above, by disposing the terminating end 205*b* of the inclined surface 205 in a distance range of less than or equal to 0.8 times r from the center C of the opening 211, the ink that passes over the inclined surface 205 and flows in a vector direction of the −Y direction and the +Z direction flows into the nozzle 21, it is possible to generate a flow of the ink inside the nozzle 21, and it is possible to more efficiently collect the ink in the vicinity of the nozzle 21.

As illustrated in FIG. 3, an inclination θ of the inclined surface 205 with respect to the Y direction, which is the second axis, is preferably 30° to 55°. Here, the inclination θ of the inclined surface 205 is the angle of the line L connecting the starting end 205*a* and the terminating end 205*b* of the inclined surface 205 with respect to the Y direction. As described above, by setting the inclination θ of the inclined surface 205 to 30° to 55°, a flow of the ink toward the nozzle 21 along the surface of the inclined surface 205 is generated, it is possible to generate a flow of the ink inside the nozzle 21, and it is possible to more efficiently collect the ink in the vicinity of the nozzle 21.

As illustrated in FIG. 3, when R is the diameter of the opening 211 on the second flow path 202 side of the nozzle 21, the opening 211 is preferably provided in a range of 3R, and more preferably in a range of 2R from the coupled position between the first flow path 201 and the second flow path 202 in the Y direction, which is the second axial direction. Here, the diameter R of the nozzle 21 refers to the width dimension of the widest portion of the opening 211 in the Y direction when the opening 211 is a shape other than a circle, for example, an ellipse, an oval, a rectangle, a polygon, a bulbous shape, or the like. The coupled position between the first flow path 201 and the second flow path 202 refers to the position of the end portion of the second flow path 202 closest to the first flow path 201, and in the present embodiment, refers to the starting end 205*a* of the inclined surface 205. The opening 211 of the nozzle 21 being preferably provided in the range of 3R and more preferably in the range of 2R refers to the center C of the opening 211 preferably being provided in the range of 3R, more preferably in the range of 2R in the −Y direction from the starting end 205*a* of the inclined surface 205. As described above, the center C of the opening 211 refers to the area center of gravity of the opening 211 when the opening 211 is not a circle.

As described above, by providing the opening 211 preferably in a range of 3R, more preferably in a range of 2R from the starting end 205*a* which is a coupled position between the first flow path 201 and the second flow path 202, the ink flowing obliquely along the surface of the inclined surface 205 is caused to flow into the nozzle 21, it is possible to generate a flow of the ink inside the nozzle 21, and it is possible to more efficiently collect the ink in the vicinity of the nozzle 21.

As described above, the ink jet recording head 1 which is an example of the liquid ejecting head of the present embodiment is provided with the pressure chamber 12, the first flow path 201, the second flow path 202, and the nozzle 21. The pressure chamber 12 includes the supply port 43 and the outlet port 44 of the ink which is a liquid and is a pressurization chamber communicating with one of the supply port 43 and the outlet port 44, the first flow path 201 communicates with the pressure chamber 12 and extends in the Z direction, which is the first axial direction, the second flow path 202 communicates with the other of the supply port 43 and the outlet port 44 and is the second flow path 202 which branches from the first flow path 201 and extends in the Y direction, which is the second axial direction orthogonal to the Z direction, and the nozzle 21 is provided to branch from the second flow path 202 and is the nozzle 21 which discharges the ink along the Z direction. When viewed in the X direction, which is the third axial direction orthogonal to the Z direction and the Y direction, the inclined surface 205 inclined with respect to the Z direction and the Y direction is included on the inner walls at a location at which the second flow path 202 and the first flow path 201 intersect.

By providing the inclined surface 205 on the inner wall at the location at which the second flow path 202 and the first flow path 201 intersect, it is possible to generate a flow of the ink inclined along the surface of the inclined surface 205 when the ink flowing through the first flow path 201 in the Z direction is caused to flow through the second flow path 202 in the Y direction. According to the inclined flow of the ink, the ink is caused to flow toward the nozzle 21, the flow of the ink inside the nozzle 21 is generated, and it is possible to replace the ink inside the nozzle 21 with new ink supplied from upstream. Therefore, it is possible to suppress the ink being retained inside the nozzle 21 and it is possible to suppress the occurrence of discharging faults such as clogging of the nozzle 21 caused by an increase in the viscosity of the retained ink, displacement of the flight direction of the ink droplet discharged from the nozzle 21, and the like.

By providing the inclined surface 205, it is possible to reduce the flow path resistance from the pressure chamber 12 to the nozzle 21. Therefore, it is possible to reduce the pressure loss from the pressure chamber 12 to the nozzle 21 and suppress a reduction in the weight of the ink droplets to be discharged from the nozzle 21. Therefore, it is not necessary for the piezoelectric actuator 300 to be driven at a higher drive voltage and it is possible to improve the discharging efficiency. Naturally, the nozzle 21 may be disposed at a position communicating with the middle of the second flow path 202.

By disposing the nozzle 21 at a position branched from the second flow path 202, it is possible to dispose the nozzle 21 away from a portion at which the ink is retained, such as a corner portion between the first flow path 201 and the nozzle plate 20, and the ink and air bubbles in which a component settles due to the retaining do not easily move to the nozzle 21 side. Therefore, it is possible to suppress clogging of the nozzle 21 caused by the ink or bubbles in which the component settles due to the retaining, variation in the components of ink droplets to be discharged from the nozzle 21, and the like.

In the recording head 1 of the present embodiment, the inclined surface 205 is preferably formed as a concave surface that is concave toward the outside of the flow path. Accordingly, it is possible to easily form the inclined surface 205 using isotropic etching.

In the present embodiment, the description is made on the assumption that the flow of the ink flows from the first common liquid chamber 101 to the second common liquid chamber 102 via the pressure chamber 12, the first flow path 201, and the second flow path 202. However, it is possible to use the recording head 1 in which the opposite flow is generated, that is, the ink flows sequentially from the second common liquid chamber 102 to the second flow path 202, the first flow path 201, the pressure chamber 12, and the first common liquid chamber 101. Even in such a case, since the streamline of the ink from the second flow path 202 to the first flow path 201 is generated directly above the nozzle 21, it is possible to efficiently collect the ink in the vicinity of the nozzle 21.

Here, the method for manufacturing the recording head 1 of the present embodiment, particularly, the method for manufacturing the second communicating plate 152 will be described with reference to FIGS. 7 to 12. FIGS. 7 to 12 are sectional diagrams illustrating the method for manufacturing a recording head.

Figure 7:
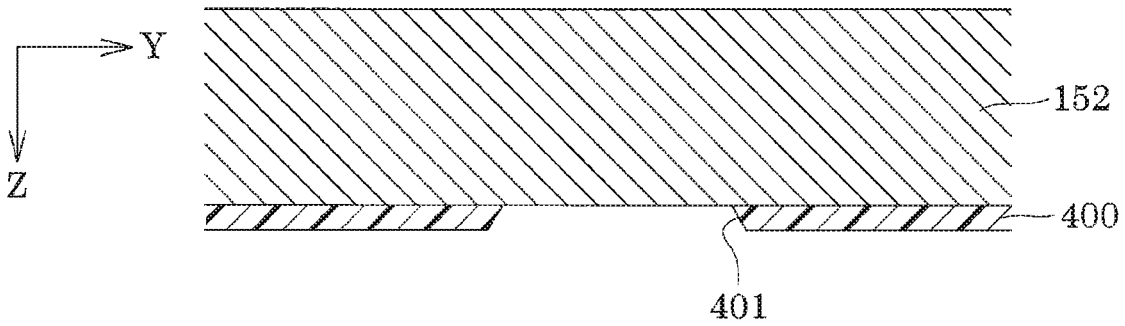
FIG. 7 is a sectional diagram illustrating a method for manufacturing the recording head according to Embodiment 1.

First, as illustrated in FIG. 7, a first mask 400 including a first opening portion 401 in a portion to be the inclined surface 205 is formed in the +Z side surface of the second communicating plate 152. It is possible to use a photoresist formed of a photosensitive resin as the first mask 400. A silicon substrate is used as the second communicating plate 152.

Figure 8:
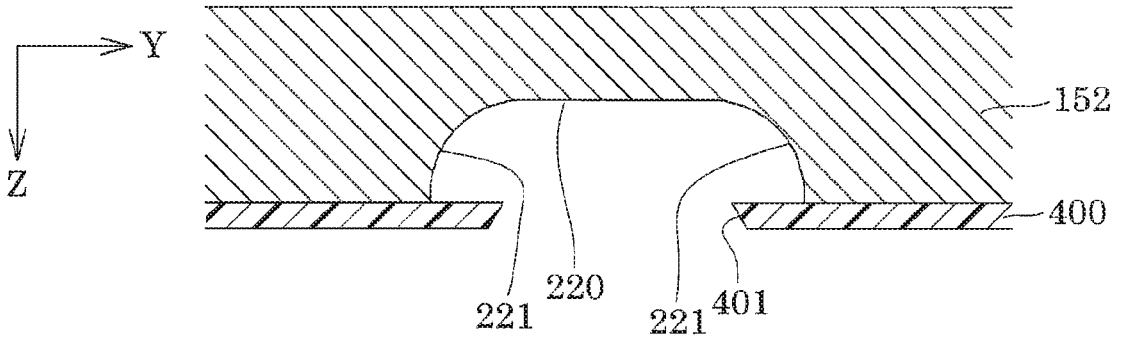
FIG. 8 is a sectional diagram illustrating the method for manufacturing the recording head according to Embodiment 1.

Next, as illustrated in FIG. 8, a recessed portion 220 having an inclined surface 221 is formed in a portion corresponding to the first opening portion 401 by performing isotropic etching on the second communicating plate 152 via the first mask 400. In other words, in the isotropic etching of the second communicating plate 152, the recessed portion 220 having the inclined surface 221 formed on both side surfaces in the −Y direction and the +Y direction is formed. It is possible to perform the isotropic etching of the second communicating plate 152 by performing dry etching using an etching gas such as a perfluorocarbon such as $CF_4$, $C_2F_6$, $C_3F_8$, or $C_4F_8$, or a hydrofluorocarbon such as $CHF_3$. Alternatively, isotropic dry etching using $SF_6/C_4H_8$ gas may be used. Alternatively, etching using a reactive gas such as $XeF_2$ may be used.

Figure 9:
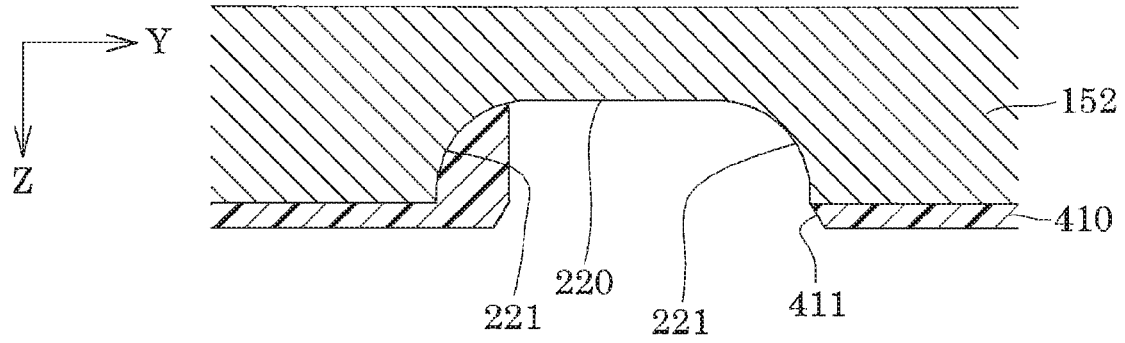
FIG. 9 is a sectional diagram illustrating the method for manufacturing the recording head according to Embodiment 1.

Next, as illustrated in FIG. 9, after the first mask 400 is peeled off, a second mask 410 which covers the inclined surface 221 on the −Y side of the recessed portion 220 and which includes a second opening portion 411 in a region where the first flow path 201 is formed. At this time, the inclined surface 221 on the +Y side of the recessed portion 220 is exposed by the second opening portion 411.

Figure 10:
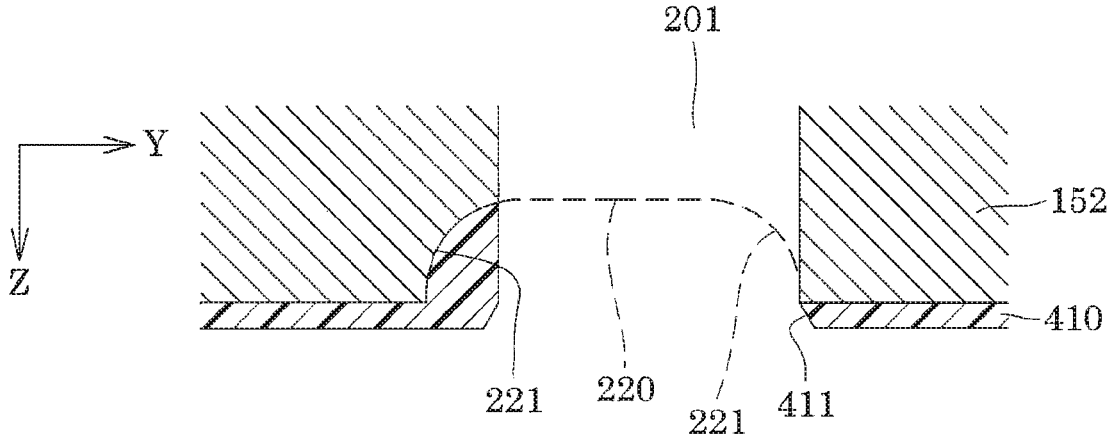
FIG. 10 is a sectional diagram illustrating the method for manufacturing the recording head according to Embodiment 1.

Next, as illustrated in FIG. 10, by anisotropically etching the second communicating plate 152 via the second mask 410, a portion of the first flow path 201 on the +Z side is formed. At this time, by covering the inclined surface 221 on the −Y side with the second mask 410 in the previous step, it is possible to form the first flow path 201 by etching areas other than the inclined surface 221 without etching the inclined surface 221 using anisotropic etching. Since the inclined surface 221 on the +Y side is exposed by the second opening portion 411, the inclined surface 221 on the +Y side is removed when forming the first flow path 201 using anisotropic etching. It is possible to perform the anisotropic etching of the second communicating plate 152, for example, by wet etching using an alkaline solution such as KOH.

Figure 11:
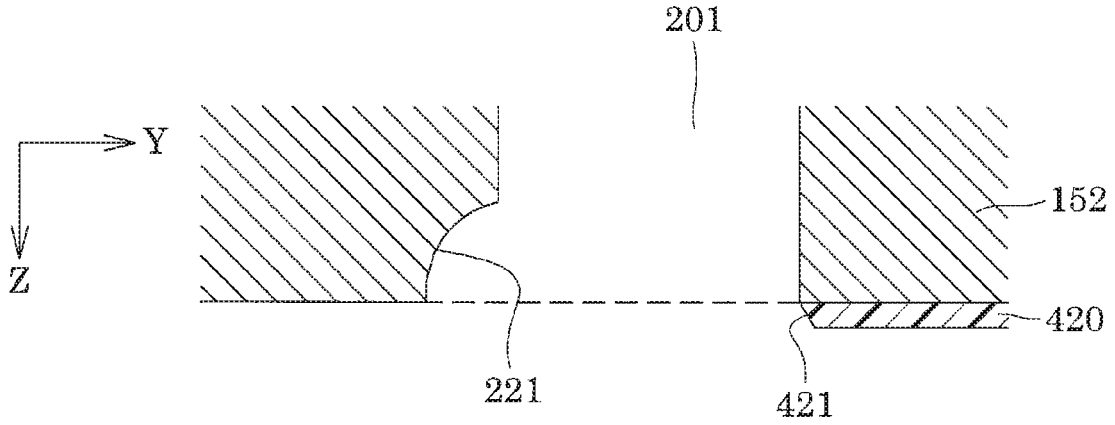
FIG. 11 is a sectional diagram illustrating the method for manufacturing the recording head according to Embodiment 1.

Next, as illustrated in FIG. 11, after the second mask 410 is peeled off, a third mask 420 having a third opening portion 421 is formed in a region in which the second flow path 202 is formed.

Figure 12:
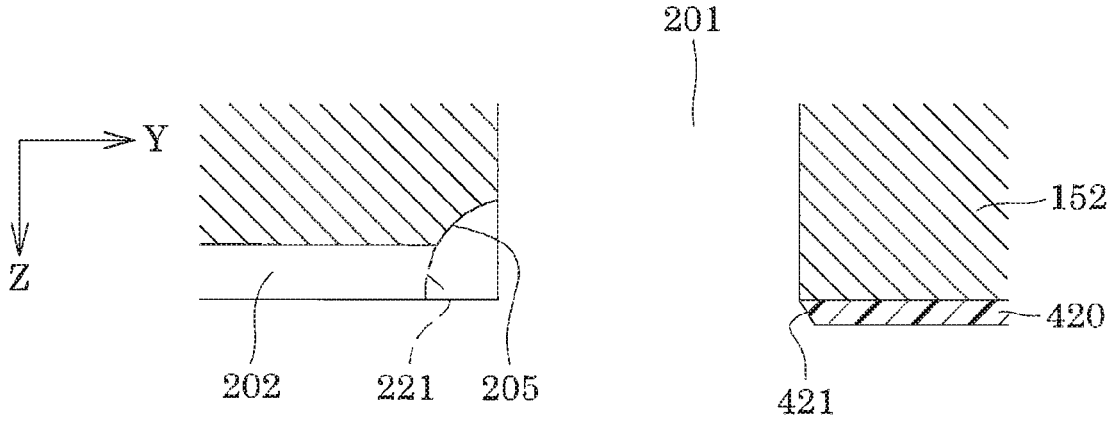
FIG. 12 is a sectional diagram illustrating the method for manufacturing the recording head according to Embodiment 1.

Next, as illustrated in FIG. 12, by anisotropically etching the second communicating plate 152 via the third mask 420, the second flow path 202 is formed. At this time, part of the inclined surface 221 on the +Z side is removed by etching and a portion remaining on the −Z side becomes the inclined surface 205. Accordingly, it is possible to manufacture the second communicating plate 152 in which the first flow path 201, the second flow path 202, and the inclined surface 205 are formed.

Although not particularly depicted, in the step of forming the first flow path 201 by anisotropically etching the second communicating plate 152, by forming part of the first communicating portion 16 on the +Z side and the third communicating portion 18 simultaneously, it is possible to suppress an increase in the number of steps for manufacturing the second communicating plate 152. Naturally, the first communicating portion 16 and the third communicating portion 18 may be formed in a different step from the step of forming the first flow path 201 in the second communicating plate 152.

It is possible to form the communicating plate 15 by joining the first communicating plate 151 to the −Z side of the second communicating plate 152 manufactured in this manner. The −Z side of the first flow path 201, the supply path 203, part of the −Z side of the first communicating portion 16, the second communicating portion 17, and the like are formed in the first communicating plate 151.

Thereafter, the communicating plate 15 is manufactured by joining the first communicating plate 151 and the second communicating plate 152 in which the −Z side of the first flow path 201 is formed. It is possible to manufacture the recording head 1 of the present embodiment by joining an actuator unit in which the flow path forming substrate 10 in which the pressure chamber 12, the diaphragm 50, the piezoelectric actuator 300, and the like are formed, and the protection substrate 30 are integrated to the communicating plate 15 and by joining the nozzle plate 20 in which the nozzle 21 is formed, the compliance substrate 49, the case member 40, and the like to the communicating plate 15.

As described above, in the method for manufacturing the recording head 1 which is an example of the liquid ejecting head of the present embodiment, there is provided the pressure chamber 12, the first flow path 201, the second flow path 202, and the nozzle 21. The pressure chamber 12 includes the supply port 43 and the outlet port 44 for the ink which is a liquid and is a pressurization chamber communicating with one of the supply port 43 and the outlet port 44, the first flow path 201 communicates with the pressure chamber 12 and extends in the Z direction, which is the first axial direction, the second flow path 202 communicates with the other of the supply port 43 and the outlet port 44 and is the second flow path 202 which branches from the first flow path 201 and extends in the Y direction, which is the second axial direction intersecting the Z direction, and the nozzle 21 is provided to branch from the second flow path 202 and is the nozzle 21 which discharges the ink along the Z direction. When viewed in the X direction, which is the third axial direction orthogonal to the Z direction and the Y direction, the inclined surface 205 inclined in the Z direction and the Y direction is included on the inner walls at a location at which the second flow path 202 and the first flow path 201 intersect. The method includes a step of forming the inclined surface 205 by isotropically etching the second communicating plate 152 which is a substrate, and a step of forming at least part of the first flow path 201 in the Z direction by anisotropically etching portions other than the inclined surface 205 of the second communicating plate 152 in which the inclined surface 205 is formed.

As described above, due to forming the inclined surface 221 to form the inclined surface 205 by isotropically etching the second communicating plate 152 which is a substrate and forming the first flow path 201 by anisotropically etching the second communicating plate 152, it is possible to easily form the inclined surface 205 with high precision.

In the present embodiment, since the communicating plate 15 includes the first communicating plate 151 and the second communicating plate 152, part of the first flow path 201 on the +Z side is formed by anisotropically etching the second communicating plate 152. However, the configuration is not limited thereto, and for example, when the communicating plate 15 is configured by a single substrate, the entirety of the first flow path 201 may be formed by anisotropically etching the communicating plate 15.

In the present embodiment, although the second flow path 202 is formed by anisotropically etching the second communicating plate 152, when the second flow path 202 is formed by providing a recessed portion in the nozzle plate 20, the step of forming the second flow path 202 by anisotropically etching the second communicating plate 152 becomes unnecessary. In other words, the step of forming the second flow path 202 by anisotropically etching the second communicating plate 152 is not always necessary.

OTHER EMBODIMENTS

Although the embodiments of the present disclosure are described above, the basic configuration of the present disclosure is not limited to the above-described embodiment.

Figure 13:
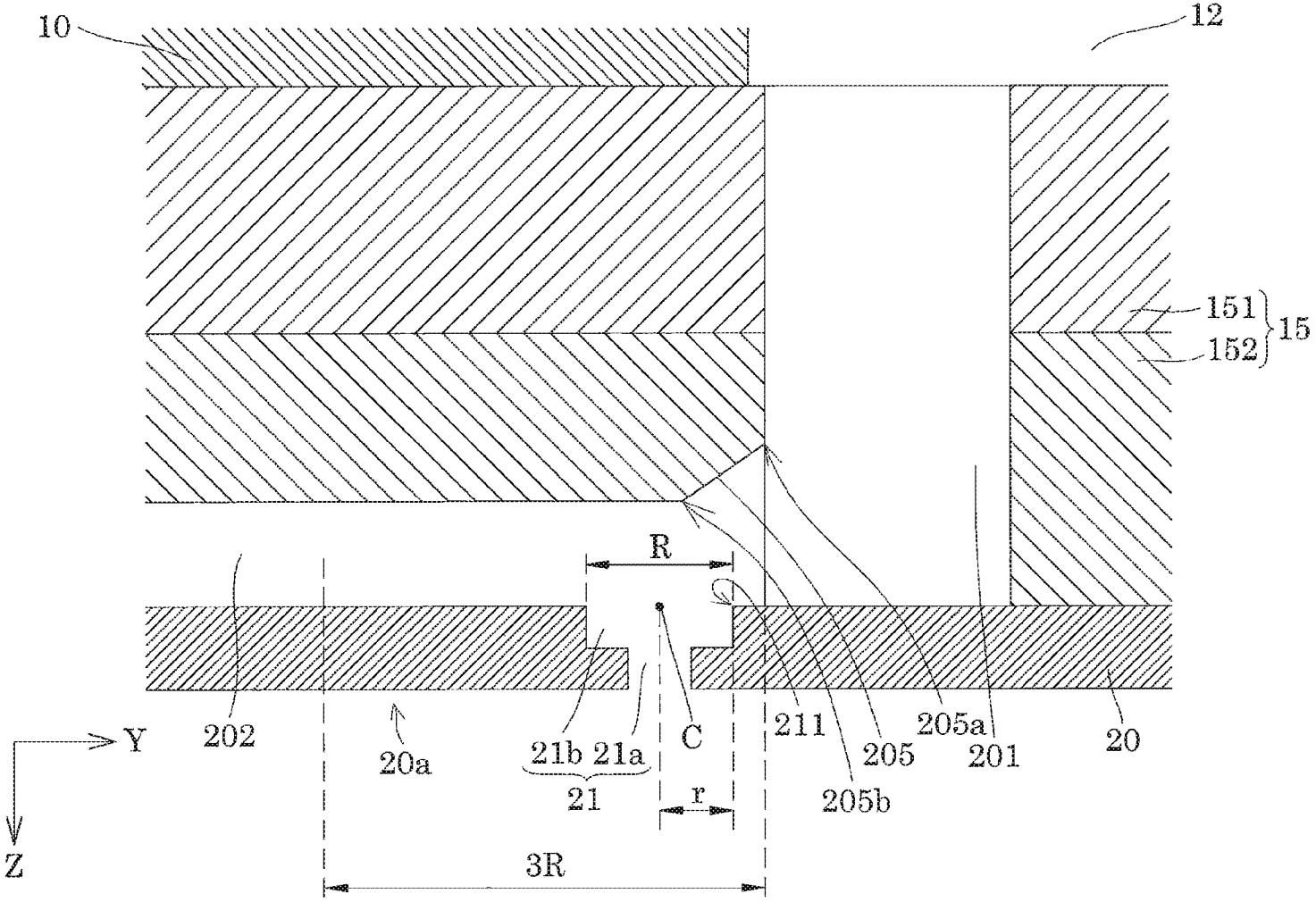
FIG. 13 is a sectional diagram illustrating a modification example of an inclined surface according to another embodiment.

For example, in Embodiment 1 described above, although the inclined surface 205 is provided to form a concave surface, the configuration is not particularly limited thereto. For example, as illustrated in FIG. 13, the inclined surface 205 may be a planar surface. Naturally, the inclined surface 205 is not limited to a concave surface or a planar surface, and may be a convex surface, or may be an inclined surface provided with at least two of a concave surface, a planar surface, and a convex surface. The inclined surface 205 is not limited to the concave surface and the convex surface, and may be provided in a stepped shape. In any case, if the line L connecting the starting end 205*a* and the terminating end 205*b* of the inclined surface 205 is inclined with respect to the Z direction and the Y direction, any surface may be formed between the starting end 205*a* and the terminating end 205*b*.

In Embodiment 1 described above, when viewed in the Z direction, although the terminating end 205*b* of the inclined surface 205 is disposed at a position overlapping the opening 211, the configuration is not particularly limited thereto, and the terminating end 205*b* may be disposed at a position that does not overlap the opening 211, that is, the terminating end 205*b* may be disposed further in the +Y direction than the opening 211, or the terminating end 205*b* may be disposed further in the −Y direction than the opening 211.

For example, in the above-described embodiment, a configuration is exemplified in which the nozzles 21 are arranged in the X direction orthogonal to both the Y direction and the Z direction with the first axial direction as the Y direction and the second axial direction as the Z direction. However, the configuration is not particularly limited thereto. For example, the nozzles 21, the pressure chambers 12, and the like may be arranged side by side in a direction inclined with respect to the X direction in the in-plane direction of the nozzle surface 20*a*.

In the present embodiment, although the first flow path 201 of the individual flow path 200 and the second common liquid chamber 102 are directly coupled, the configuration is not particularly limited thereto, and another flow path extending in the Z direction, which is the second axial direction, may be provided between the first flow path 201 and the second common liquid chamber 102.

Figure 14:
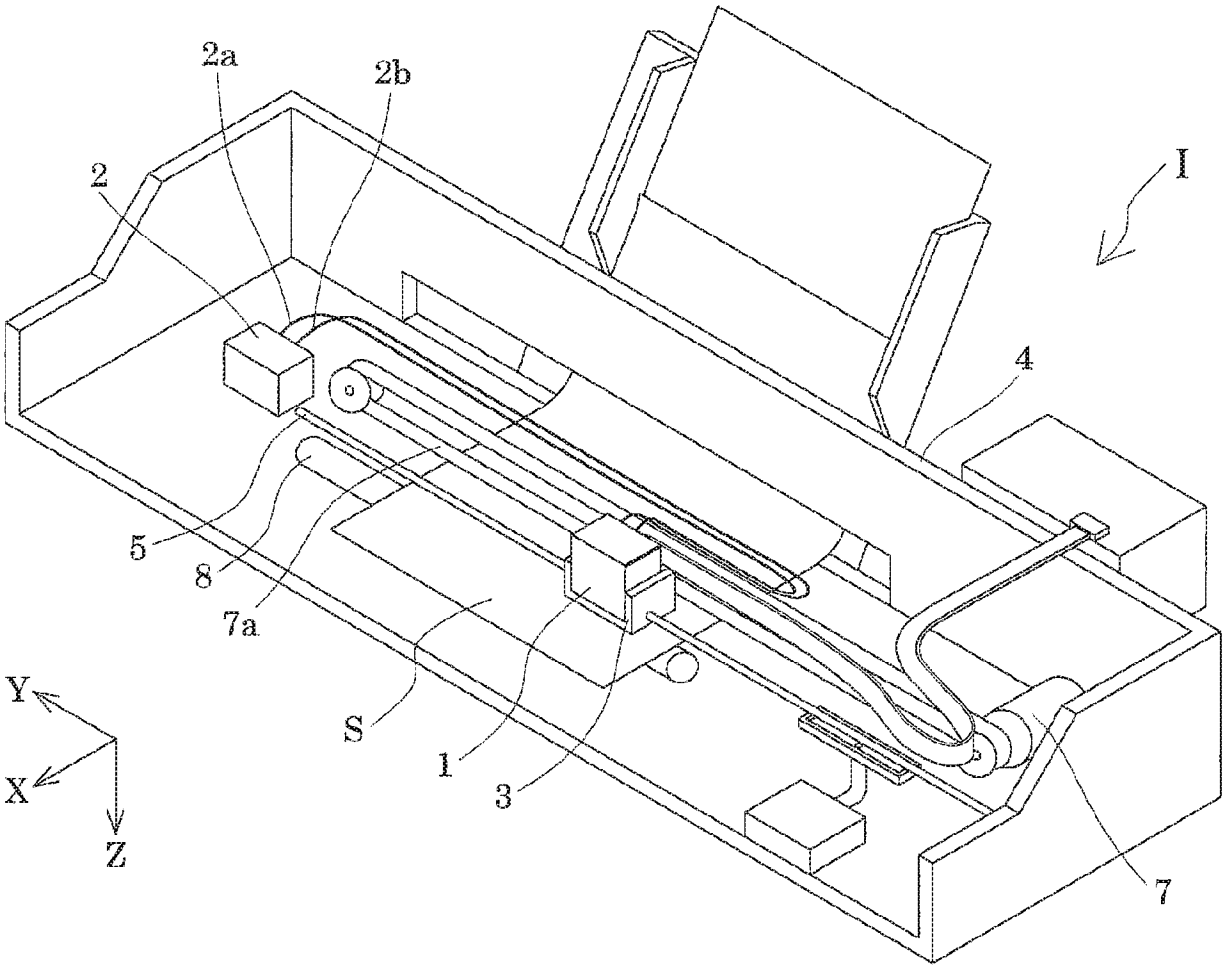
FIG. 14 is a view illustrating a schematic configuration of a recording apparatus according to an embodiment.

Here, an example of an ink jet recording apparatus, which is an example of the liquid ejecting apparatus of the present embodiment, will be described with reference to FIG. 14. FIG. 14 is a view illustrating a schematic configuration of the ink jet recording apparatus of the present disclosure.

As illustrated in FIG. 14, in an ink jet recording apparatus I, which is an example of a liquid ejecting apparatus, recording heads 1 are mounted on a carriage 3. The carriage 3 on which the recording heads 1 are mounted is provided on a carriage shaft 5 attached to an apparatus main body 4 to move freely in the axial direction. In the present embodiment, the moving direction of the carriage 3 is the Y direction, which is the first axial direction.

The apparatus main body 4 is provided with a tank 2 which is a storage unit in which ink is stored as a liquid. The tank 2 is coupled to the recording head 1 via a supply pipe 2*a* such as a tube and the ink from the tank 2 is supplied to the recording head 1 via the supply pipe 2*a*. The recording head 1 and the tank 2 are coupled via a discharge pipe 2*b* such as a tube and the ink discharged from the recording head 1 is returned to the tank 2 via the discharge pipe 2*b*, that is, so-called circulation is performed. The tank 2 may be configured by two or more tanks.

The driving force of a drive motor 7 is transmitted to the carriage 3 via gears (not illustrated) and a timing belt 7*a*, and thus, the carriage 3 on which the recording head 1 is mounted is moved along the carriage shaft 5. On the other hand, the apparatus main body 4 is provided with a transport roller 8 which serves as a transport unit and a recording sheet S which is an ejection target medium such as paper is transported by the transport roller 8. The transport unit that transports the recording sheet S is not limited to the transport roller 8 and may be a belt, a drum, or the like. In the present embodiment, the transport direction of the recording sheet S is the X direction.

In the ink jet recording apparatus I described above, a configuration is exemplified in which the recording head 1 is mounted on the carriage 3 and moves in a main scanning direction. However, the configuration is not particularly limited thereto, and for example, it is possible to apply the present disclosure to a so-called line type recording apparatus in which the recording head 1 is fixed and the printing is performed by only moving the recording sheet S such as paper in the sub-scanning direction.

In each embodiment, the ink jet recording head is described as an example of the liquid ejecting head and the ink jet recording apparatus is described as an example of the liquid ejecting apparatus. However, the present disclosure widely targets liquid ejecting heads and liquid ejecting apparatuses in general, and naturally, it is possible to apply the present disclosure to a liquid ejecting head or a liquid ejecting apparatus that ejects a liquid other than the ink. Examples of other liquid ejecting heads include various recording heads used in image recording apparatuses such as printers, color material ejecting heads used in manufacturing color filters of liquid crystal displays and the like, electrode material ejection heads used for forming electrodes of organic EL displays, FEDs (field emission displays), and the like, and biological organic material ejection heads used for manufacturing biochips, and it is also possible to apply the present disclosure to a liquid ejecting apparatus provided with such a liquid ejecting head.

Figure 15:
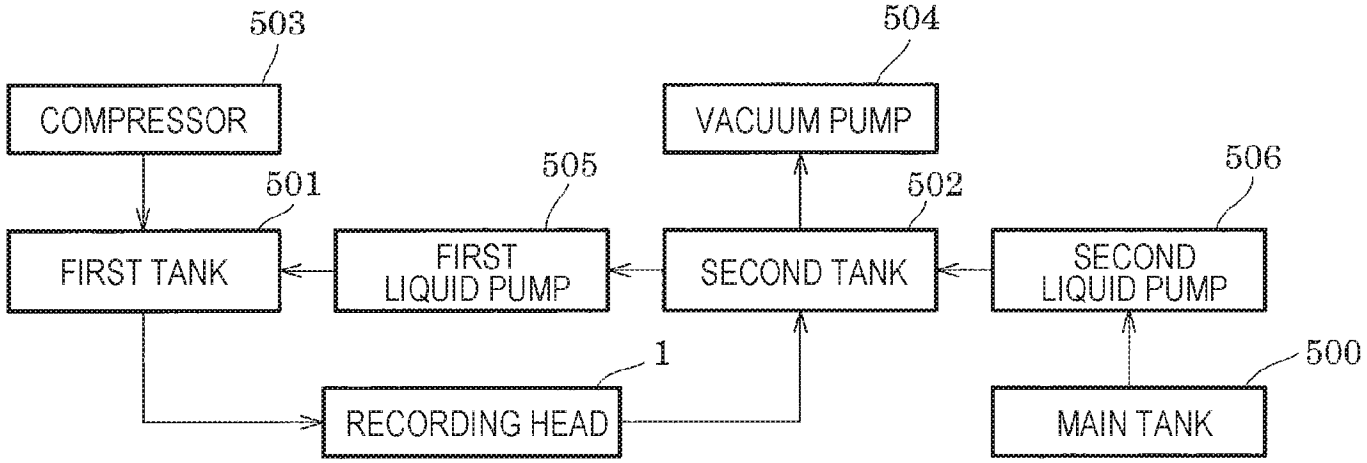
FIG. 15 is a block diagram illustrating a liquid ejecting system according to an embodiment.

Here, an example of the liquid ejecting system of the present embodiment will be described with reference to FIG. 15. FIG. 15 is a block diagram illustrating the liquid ejecting system of the ink jet recording apparatus which is the liquid ejecting apparatus of the present disclosure.

As illustrated in FIG. 15, the liquid ejecting system includes the recording head 1 and, as a mechanism for supplying the ink as the liquid to the supply port 43, collecting the ink from the outlet port 44, and circulating the ink, includes a main tank 500, a first tank 501, a second tank 502, a compressor 503, a vacuum pump 504, a first liquid pump 505, and a second liquid pump 506.

The recording head 1 and the compressor 503 are coupled to the first tank 501, and the ink in the first tank 501 is supplied to the recording head 1 at a predetermined pressure by the compressor 503.

The second tank 502 is coupled to the first tank 501 via the first liquid pump 505, and the ink in the second tank 502 is pumped to the first tank 501 by the first liquid pump 505.

The recording head 1 and the vacuum pump 504 are coupled to the second tank 502, and the ink of the recording head 1 is discharged to the second tank 502 at a predetermined negative pressure by the vacuum pump 504.

In other words, the ink is supplied from the first tank 501 to the recording head 1 and the ink is discharged from the recording head 1 to the second tank 502. The ink is circulated by the ink being pumped from the second tank 502 to the first tank 501 by the first liquid pump 505.

The main tank 500 is coupled to the second tank 502 via the second liquid pump 506, and an amount of the ink corresponding to that consumed by the recording head 1 is replenished in the second tank 502 from the main tank 500. The replenishment of the ink in the second tank 502 from the main tank 500 may be performed, for example, at a timing when the liquid level of the ink in the second tank 502 becomes lower than a predetermined height.

What is claimed is:

1. A liquid ejecting head having a supply port and a outlet port for liquid, the liquid ejecting head comprising:

a pressurization chamber communicating with one of the supply port and the outlet port;

a first flow path communicating with the pressurization chamber and extending in a first axial direction;

a second flow path communicating with the other of the supply port and the outlet port, branching from the first flow path, and extending in a second axial direction orthogonal to the first axial direction; and a nozzle that is provided to branch from the second flow path and that discharges the liquid along the first axial direction, wherein when viewed in a third axial direction orthogonal to the first axial direction and the second axial direction, an inner wall at a location at which the second flow path and the first flow path intersect includes an inclined surface inclined with respect to the first axial direction and the second axial direction.

2. The liquid ejecting head according to claim 1, wherein an end of the inclined surface on a side facing the second flow path overlaps an opening of the nozzle on a second flow path side when viewed in the first axial direction.

3. The liquid ejecting head according to claim 2, wherein when viewed in the first axial direction and r is a radius of the opening, the end of the inclined surface is disposed in a distance range of less than or equal to 0.8 times r from a center of the opening.

4. The liquid ejecting head according to claim 1, wherein an inclination of the inclined surface with respect to the second axial direction is 30° to 55°.

5. The liquid ejecting head according to claim 1, wherein when R is a diameter of an opening of the nozzle on a second flow path side, the opening is provided in a range of 3R from a coupled position between the first flow path and the second flow path in the second axial direction.

6. The liquid ejecting head according to claim 5, wherein the opening of the nozzle on the second flow path side is provided in a range of 2R from the coupled position between the first flow path and the second flow path.

7. The liquid ejecting head according to claim 1, wherein the inclined surface is formed as a concave surface that is concave toward an outside of a flow path.

8. A liquid ejecting system comprising:

the liquid ejecting head according to claim 1; and a mechanism for supplying the liquid to the supply port, collecting the liquid from the outlet port, and circulating the liquid.

9. A method for manufacturing a liquid ejecting head including a supply port and a outlet port for a liquid, a pressurization chamber communicating with one of the supply port and the outlet port, a first flow path communicating with the pressurization chamber and extending in a first axial direction, and a second flow path communicating with the other of the supply port and the outlet port, branching from the first flow path, and extending in a second axial direction orthogonal to the first axial direction, and a nozzle that is provided to branch from the second flow path and that discharges the liquid along the first axial direction, and when viewed in a third axial direction orthogonal to the first axial direction and the second axial direction, an inner wall at a location at which the second flow path and the first flow path intersect includes an inclined surface inclined with respect to the first axial direction and the second axial direction, the method comprising:

forming the inclined surface by isotropically etching a substrate; and forming at least part of the first flow path in the first axial direction by anisotropically etching portions other than the inclined surface of the substrate on which the inclined surface is formed.

* * * * *